US009551556B2

(12) United States Patent
Sturm

(10) Patent No.: US 9,551,556 B2
(45) Date of Patent: Jan. 24, 2017

(54) CHEMICAL DETONATOR WITH ELECTRIC TRIGGER

(71) Applicant: Fr. Sobbe GmbH, Dortmund (DE)

(72) Inventor: Joachim Sturm, Lohmar (DE)

(73) Assignee: Fr. Sobbe GmbH, Dortmund (DE)

( * ) Notice: Subject to any disclaimer, the term of this patent is extended or adjusted under 35 U.S.C. 154(b) by 0 days.

(21) Appl. No.: 14/877,960

(22) Filed: Oct. 8, 2015

(65) Prior Publication Data

US 2016/0102957 A1 Apr. 14, 2016

(30) Foreign Application Priority Data

Oct. 8, 2014 (DE) ..... 10 2014 114 566

(51) Int. Cl.

| | |
|---|---|
| ***F42B 3/107*** | (2006.01) |
| ***F42C 19/08*** | (2006.01) |
| ***F42B 3/103*** | (2006.01) |
| ***F42B 3/11*** | (2006.01) |
| ***F42B 3/12*** | (2006.01) |
| ***F42B 3/18*** | (2006.01) |
| ***F42B 3/182*** | (2006.01) |

(52) U.S. Cl.

CPC ..... *F42C 19/08* (2013.01); *F42B 3/103* (2013.01); *F42B 3/11* (2013.01); *F42B 3/125* (2013.01); *F42B 3/18* (2013.01); *F42B 3/182* (2013.01)

(58) Field of Classification Search

CPC ..... F42B 3/103; F42B 3/107; F42B 3/11
USPC ..... 102/202.7, 202.8, 202.9, 202.11, 202.14
See application file for complete search history.

(56) References Cited

U.S. PATENT DOCUMENTS

| | | | | |
|---|---|---|---|---|
| 3,366,055 A * | 1/1968 | Hollander, Jr. | F42B 3/13 | 102/202.7 |
| 6,164,208 A * | 12/2000 | Hsu | F42B 3/103 | 102/202 |
| 2004/0083919 A1* | 5/2004 | Hosey | F42B 3/121 | 102/202.12 |

FOREIGN PATENT DOCUMENTS

| | | |
|---|---|---|
| EP | 567 959 | * 11/1993 |

* cited by examiner

*Primary Examiner* — Stephen M Johnson
(74) *Attorney, Agent, or Firm* — James Creighton Wray; Meera P. Narasimhan

(57) ABSTRACT

The necessary ESD safety for chemical detonators 1 is ensured by the fact that the sleeve 2 of the chemical detonator 1 is closely encompassed by an aluminum sleeve 20, the ignition pill 5 is sealed in addition by a casting compound 21 and a predetermined flashover position 26 is provided for the priming wires 3, 4.

10 Claims, 2 Drawing Sheets

28
10
27
8
34
9
2
15'
35
36
5,7
21
23
5,6
26
1
4
3

9
35
22
11
3,4

CHEMICAL DETONATOR WITH ELECTRIC TRIGGER

This application claims the benefit of German Application No. 10 2014 114 566.6 filed Oct. 8, 2014, which is hereby incorporated by reference in their entirety as if fully set forth herein.

The invention concerns a chemical detonator with a sleeve made of plastic that holds both an ignition pill connected with priming wires, a primer composition and an incendiary agent as well as a pyrotechnic substance and is sealed towards the sleeve outlet with a stopper and towards the sleeve inlet with the priming wires through the ignition pill.

Detonators of this kind are mainly used as initiators for an ignition chain or similar. The ignition pill comprises a primer composition and an incendiary agent that, when triggered electrically, causes the upstream pyrotechnic substance as the initiator to trigger the downstream explosive devices with a time lag. With previously known detonators of this kind, both the ignition pill and the pyrotechnic substance are arranged in a sleeve, whereby the ignition pill is connected with priming wires that can be connected to the ignition pill at the sleeve inlet. This sleeve is usually made of polyamide, an easily conductive plastic. Static electric charging in the area of such detonators can occur both during storage and above all on transport and in the area of application. On discharge, a spark or disruptive discharge caused by a great potential difference can endanger the detonator or trigger it, which can lead to an uncontrolled ignition of the chemicals, i.e. the parts of the detonator, which can to serious problems in spite of the slight amounts of pyrotechnical material in the detonator.

The invention is therefore based on the task of creating a chemical detonator that is ESD (electrostatic discharge) safe and thus conforms to the EC type examination of the BAM (Federal Institute for Materials Research and Testing).

The task is solved in accordance with the invention by surrounding the sleeve with a tightly fitting aluminum sleeve and sealing the ignition pill with casting compound against the funnel-shaped tapering inside wall of the sleeve.

Electrostatic charging at the housing or the actual sleeve cannot occur with a chemical detonator constructed in this way, so that therefore there cannot be a false or negative influence on the material stored in the sleeve. At the same time, this material stored in the sleeve is also secured through additional influences, because an influence cannot occur past the priming wires and the ignition pill, because the above-mentioned casting compound ensures the required tightness here. With this specially constructed and secured detonator it was possible to carry out the ESD test with up to 600 mJ Ohm successively (no ignition). This means that the chemical detonator that is used guarantees the required safety for normal energy level classes. Unintentional ignition cannot occur through electrostatic charging.

In accordance with an expedient embodiment of the invention it is planned that a predetermined flashover position is provided in the area of the connection between priming wires and ignition pill. Uncontrolled flashovers can be prevented through the described tight encapsulation of the corresponding triggering compositions etc. and the described predetermined flashover position, even if there should be electrostatic charging in this area.

The stopper is designed, as mentioned, so that there cannot be any influencing of the pyrotechnic substance stored behind it and of the other parts of the detonator. In order to ensure that the stopper does not impair the function of the pyrotechnic substance when the latter is triggered, it is provided that the stopper has a predetermined breaking point. If a corresponding pressure build-up occurs in the part of the sleeve containing the pyrotechnic substance, the stopper is safely destroyed and the pyrotechnic substance can fulfill its function in full.

To optimize the function of the stopper it is expedient if wadding is provided between the stopper and the pyrotechnic composition, whereby this should consist expediently of absorbent paper. In the event of adverse storage conditions and impact on the chemical detonator, this absorbent wadding also prevents the pyrotechnic substance being impaired, for example by damp.

The casting compound in accordance with the invention in the area of the ignition pill can be inserted simply and safely and fully functioning if an adhesive is used as the casting compound, preferably a two-component epoxy resin adhesive. This epoxy resin adhesive is particularly suitable here because it has an effect on the sleeve material and at the same time on the ignition pill so that unintentional destruction of the casting compound is absolutely impossible. In this way, it is ensured that the casting compound always retains its full function in the case of longer storage periods as well and even of stresses.

The detonators have different energy level classes depending on the application field. To ensure here that a detonator with the correct energy level class is used, the invention provides that the stopper has a color that identifies the energy level class of the respective detonator that is used. It is advantageous here that the stopper that is necessary anyway is always easily recognizable, even with appropriate storage in boxes or similar, whereby the task or effect of the stopper is not impaired in any way whatsoever through this color. Only a relatively small part of the detonator needs to be colored, whereby as mentioned the stopper as such is always easily identifiable. For the sake of expedience, the color should be chosen so that black is used for the highest energy level class to make it clear that a large pyrotechnic composition is being used.

On the one hand, it is to be ensured that electrostatic charging is ineffective or does not occur in the first place, and on the other hand it is important that the required primer is brought safely and quickly via the priming wires into the desired area of the detonator. This is ensured if the priming wires are made of copper-plated, tin-plated or galvanized iron or from copper and have PVC insulation. An effect on the detonators from outside can be ruled out with priming wires designed in this way.

The already mentioned different energy level classes are characterized in particular in that a different amount of pyrotechnic material is used. To enable, for example, a higher energy level class, the invention provides that the sleeve is designed to be extendable to higher energy level classes by means of an attachment, whereby sleeve and attachment are bordered by a continuous aluminum sleeve that surrounds them. An advantage here is that the same sleeve with its special features can always be used, whereby the "contents" of the sleeve can be changed in accordance with the respective energy level classes. Energy level classes up to 5000 Ws, 10,000 Ws and 20,000 Ws for example, are usual.

The invention is characterized in particular in that a chemical detonator is created that meets the ESD requirement in full, so that risks caused by such electrostatic charging can no longer arise. This is achieved through the change to the sleeve's outer sheath, but also through sealing the actual internal space of the corresponding sleeve of the chemical detonator. It has been shown that ignitions through electrostatic charging have no longer occurred with this design of the chemical detonator.

Further details and advantages of the object of the invention can be seen in the following description of the associated drawing, in which a preferred embodiment is shown with the necessary details and individual parts.

DETAILED DESCRIPTION OF THE INVENTION

Figure 1:
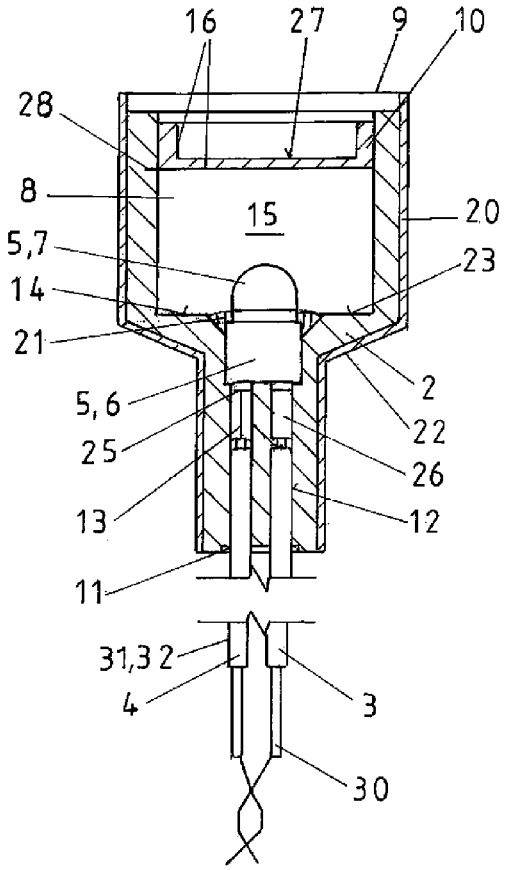
FIG. 1 shows an open view of a chemical detonator.

The chemical detonator 1 shown in FIG. 1 is one in energy level class 10,000 Ws. The funnel-shaped sleeve 2 tapering in the direction of the priming wires 3, 4 accommodates the ignition pill 5 in the area of the funnel, whereby the ignition pill 5 or its pill head 7 into which the space 15 accommodating the pyrotechnic substance 8 projects, while the pill foot 6 is fixed in place through the casting compound 21 in the bottom 14 and at the same time sealed.

From the funnel 22 of the sleeve 2 the sleeve runs with a smaller diameter to the sleeve inlet 11. In this area, openings 12 are provided for the priming wires 3, 4, whereby the priming wires 3, 4 are fixed by clamps 13 on the pill foot 6 of the ignition pill 5. There is a predetermined flashover position 26 here as well, which has the task of ensuring potential equalization if corresponding dangers exist.

An adhesive, in particular a two-component epoxy resin adhesive, is used for the casting compound 21 that is compatible both with the material of the inside wall 23 of sleeve 2 and with the material of pill foot 6 and/or provides the desired sealing function.

At the opposite end, i.e. the sleeve outlet 9, there is a stopper 10 that in the same way as the described casting compound 21 ensures that the pyrotechnic substance 8 stored in space 15 can be stored leak-proof and safely. The stopper 10 has a predetermined breaking point 27, so that it is ensured that if the pyrotechnic substance 8 reacts, the flame and/or the pressure can escape to the outside and be effective. The stopper 10 is placed from above on the sleeve 2 and seals as described as well as it does because it is secured as well by the aluminum sleeve 20 surrounding the sleeve 2. The aluminum sleeve 20 is drawn up into the area of the actual cover of the stopper 10.

Figure 2:
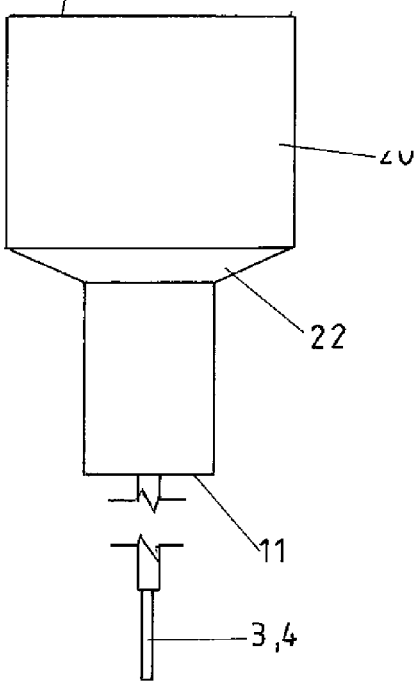
FIG. 2 shows the detonator in accordance with FIG. 1 in a side view.

This aluminum sleeve 20 surrounds the whole of the sleeve 2 from the sleeve inlet 9 to the sleeve outlet 11. The same is shown in FIG. 2 as well. Only the priming wires 3, 4 project below beyond the sleeve 2. They are connected to the blasting machine or to an otherwise suitable appliance.

The priming wires 3, 4 made of copper or appropriate iron wire are designed so that the appropriate priming wire core 30 is surrounded by a priming wire sheath 31, whereby PVC insulation 32 is to be preferred for this priming wire sheath 31.

As mentioned above, a predetermined flashover position 26 is provided in the area of the connection 25 between the priming wires 3, 4 and the clamp 13 of the ignition pill 5, which is made clear in FIG. 1. Wadding 28 is provided at the stopper 10, or rather at the insert 16, which consists of absorbent paper and is supported from underneath on the insert 16 and ensures that this area is sealed in addition towards the outside.

Figure 3:
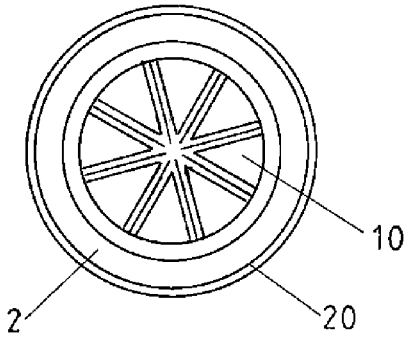
FIG. 3 shows a top view of the detonator with stopper.

FIG. 3 shows a top view onto a sleeve 2, whereby the aluminum sleeve 20 is identifiable as the outer sheath that tightly encloses the actual sleeve 20. This sleeve 2 is sealed from sides of the sleeve outlet 9 by the stopper 10.

Figure 4:
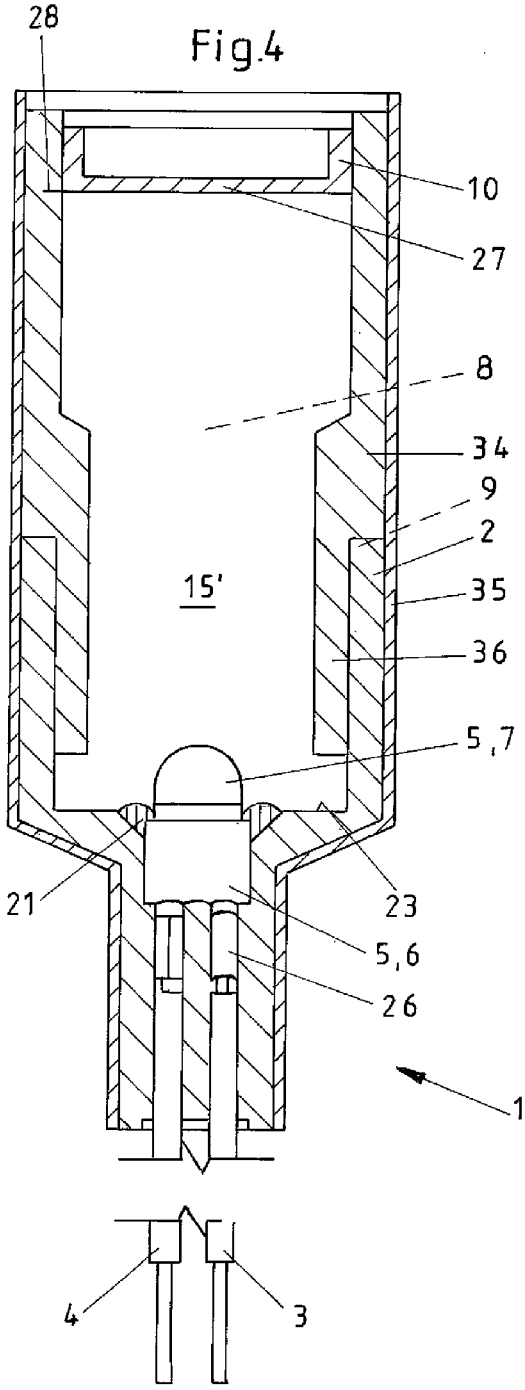
FIG. 4 shows a cross-section of a detonator in a high energy level class.

FIG. 4 shows a construction that is identical to the construction in FIG. 1 with regard to ignition pill 5 and the arrangement and/or conduction of the priming wires 3, 4. However, space 15' has been clearly enlarged in comparison with the design shown in FIG. 1. This is achieved with an attachment 34, which is placed from above on the sleeve inlet 9 and then supports the connection stopper 10 at the opposite end. The predetermined breaking point 27 and the wadding 28 can be identified here as well.

Figure 5:
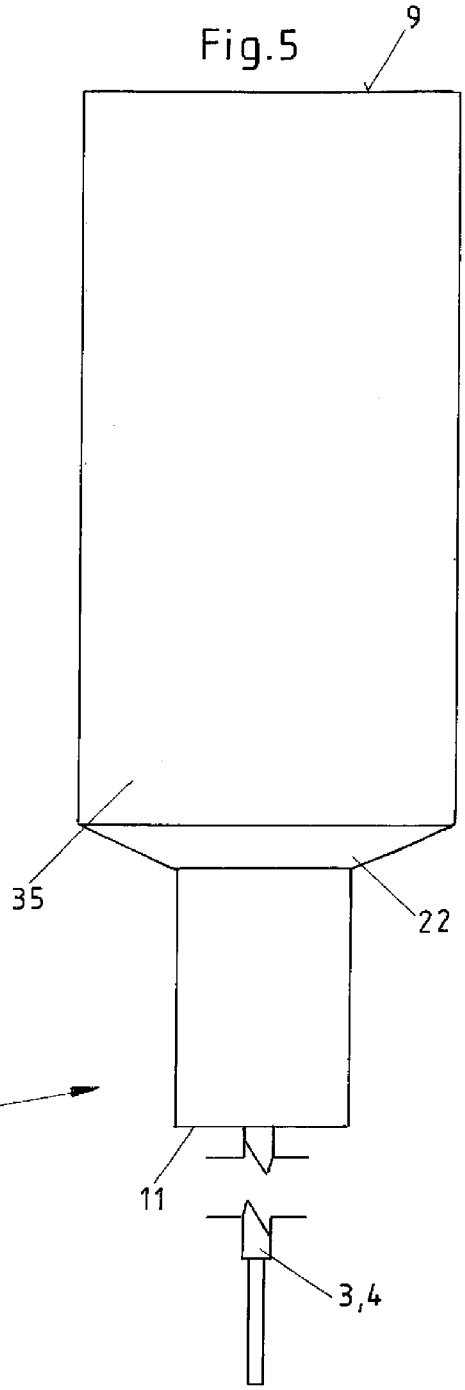
FIG. 5 shows a side view of the corresponding detonator.

The plug-in end 36 of the attachment 34 reaches so far into the "old" sleeve 2 that the whole sleeve is given the necessary stability. This stability is supported in addition in that both the attachment 34 and the old sleeve 2 are surrounded by a long continuous aluminum sleeve 35. The chemical detonator 1 shown here is intended for energy level class 20,000 Ws. FIG. 5 illustrates that the continuous aluminum sleeve 35 creates a continuous protective sheath.

All the named features, including those than can be seen solely in the drawings, are regarded by themselves and in combination as fundamental to the invention.

The invention claimed is:

1. Chemical detonator comprising a sleeve (2) consisting of plastic that holds both an ignition pill (5) connected with priming wires (3, 4), a primer composition and an incendiary agent as well as a pyrotechnic substance (8) and is sealed towards a sleeve outlet (9) with a stopper (10) and towards a sleeve inlet (11) with the priming wires (3, 4) through the ignition pill (5), wherein the sleeve (2) is surrounded by a tight fitting aluminum sleeve (20) and the ignition pill (5) is sealed against a funnel-shaped tapering inside wall (23) of the sleeve (2) with a casting compound (21).

2. Chemical detonator in accordance with claim 1, wherein a predetermined flashover position (26) is provided in an area of connection (25) between the priming wires (3, 4) and the ignition pill (5).

3. Chemical detonator in accordance with claim 1, wherein the stopper (10) has a predetermined breaking point (27).

4. Chemical detonator in accordance with claim 1, wherein wadding (28) is provided between the stopper (10) and pyrotechnic substance (8).

5. Chemical detonator in accordance with claim 4, wherein the wadding (28) between the stopper (10) and the pyrotechnic substance (8) is made of absorbent paper.

6. Chemical detonator in accordance with claim 1, wherein the casting compound is an adhesive.

7. Chemical detonator in accordance with claim 1, wherein the stopper (10) has a color that identifies the energy level class of the respective detonator (1).

8. Chemical detonator in accordance with claim 1, wherein the priming wires (3, 4) are made of copper-plated, tin-plated or galvanized iron or of copper and have a PVC insulation (32).

9. Chemical detonator in accordance with claim 1, further comprising an attachment (34) to the sleeve (2) for extending the sleeve (2) to higher energy level through the attachment (34), whereby the sleeve (2) and the attachment (34) are surrounded by a continuous aluminum sleeve (35).

10. Chemical detonator in accordance with claim 6, wherein the casting compound is a two-component epoxy resin adhesive.

* * * * *